US010367246B2

(12) United States Patent
Rudys et al.

(10) Patent No.: US 10,367,246 B2
(45) Date of Patent: Jul. 30, 2019

(54) EASYLY DEPLOYABLE PHASED ANTENNA FOR A SPACECRAFT AND SYSTEM OF SUCH ANTENNAS

(71) Applicant: VILNIUS UNIVERSITY, Vilnius (LT)

(72) Inventors: Saulius Rudys, Vilnius (LT); Juras Banys, Vilnius (LT)

(73) Assignee: VILNIUS UNIVERSITY, Vilnius (LT)

( * ) Notice: Subject to any disclaimer, the term of this patent is extended or adjusted under 35 U.S.C. 154(b) by 0 days.

(21) Appl. No.: 15/570,506

(22) PCT Filed: Apr. 29, 2016

(86) PCT No.: PCT/IB2016/052438
§ 371 (c)(1),
(2) Date: Oct. 30, 2017

(87) PCT Pub. No.: WO2016/174625
PCT Pub. Date: Nov. 3, 2016

(65) Prior Publication Data

US 2018/0151938 A1 May 31, 2018

(30) Foreign Application Priority Data

Apr. 30, 2015 (LT) ..... 2015 034

(51) Int. Cl.
*H01Q 1/12* (2006.01)
*H01Q 1/28* (2006.01)
(Continued)

(52) U.S. Cl.
CPC ..... *H01Q 1/1235* (2013.01); *H01Q 1/288* (2013.01); *H01Q 19/04* (2013.01); *H01Q 21/12* (2013.01); *H01Q 3/26* (2013.01)

(58) Field of Classification Search
CPC ..... H01Q 1/1235; H01Q 1/288; H01Q 3/26; H01Q 19/04; H01Q 21/12
See application file for complete search history.

(56) References Cited

U.S. PATENT DOCUMENTS 5,313,221 A 5/1994 Denton, Jr.
7,714,797 B2 * 5/2010 Couchman ..... B64G 1/66 244/172.6
2011/0210209 A1 * 9/2011 Taylor ..... B64G 1/222 244/172.6

FOREIGN PATENT DOCUMENTS

EP 2 693 563 A1 2/2014
JP 2014-019238 A 2/2014

OTHER PUBLICATIONS

Jose Miguel Encinas Plaza et al. "Xatcobeo: Small Mechanisms for CubeSat Satellites—Antenna and Solar Array Deployment", Proceedings of the 40th Aerospace Mechanisms Symposium, NASA Kennedy Space Center, May 12-14, 2010, pp. 415-430.
(Continued)

*Primary Examiner* — Hoang V Nguyen
(74) *Attorney, Agent, or Firm* — Young & Thompson

(57) ABSTRACT

An antenna is made from strips of a shape-memory alloy or other resilient material acting as a spring with attached branches that constitute individual monopole antennas. In the folded state, the antenna looks like a strip roll and can be placed on a satellite. When in orbit, the antenna unfolds after the roll retention mechanism is released and orderly unfolds unrolling from a support frame or otherwise extends. The proposed design of monopole branches utilizes conductors of minimum length and achieves maximum directivity. Each monopole branch is connected to the signal receiver/transmitter by signal conduit elements. A system may include at least two such unfolding antennas thus achieving even greater operational effectiveness in regard to signal steerability, interference suppression and reduced moment of the satellite inertia. To prevent problems, additional measures are used that prevent unwinding of inner layers of the roll before the outer layer is extended.

8 Claims, 5 Drawing Sheets

(51) Int. Cl.

| | |
|---|---|
| ***H01Q 19/04*** | (2006.01) |
| ***H01Q 21/12*** | (2006.01) |
| *H01Q 3/26* | (2006.01) |

(56) References Cited

OTHER PUBLICATIONS

Costantine et al. "Deployable Antennas for CubeSat and Space Communications", 6th European Conference on Antennas and Propagation (EUCAP), Mar. 1, 2012, pp. 837-840.

Kelleher et al. "Electronic Scanning for Satellites", Proceedings of the National Electronics Conference, Jan. 1, 1961, pp. 290-300, vol. 17.

International Search Report, dated Aug. 25, 2016, from corresponding PCT Application PCT/IB2016/052438.

* cited by examiner

EASYLY DEPLOYABLE PHASED ANTENNA FOR A SPACECRAFT AND SYSTEM OF SUCH ANTENNAS

FIELD OF THE INVENTION

This invention relates to deployable spacecraft antennas, and more specifically with phased array deployable antennas and their systems, which can be packed into a small volume of nanosatellites.

BACKGROUND OF THE INVENTION

Recently, miniaturized satellites, such as Cube-sat nanosatellites, are increasingly widely used. The dimensions of a single nanosatellite module according to this standard are 10 cm×10 cm×10 cm. Larger satellites can also be built out of these modules. A single module normally consists of various structural elements, such as reflectors, transceivers, antennas, sensors, etc. In spite of the small dimensions, the nanosatellites are used for various tasks. Some of them require directional and steerable beam in VHF and UHF bands, as is the case when tracking ships (AIS systems), aircraft (ADS-B), and radio beacons (Argos) from space. As a rule, nanosatellites are equipped with deployable single-strip monopoly antennas (Encinas Plaza, José, Vilán J. A., Vilén, Aguado, F. Agelet, J., Barandiarán Mancheño, López Estevez, M., Martinez Fernandez, C., Sarmiento Ares, F. "*Xatcobeo: Small Mechanisms for CubeSat Satellites-Antenna and Solar Array Deployment," Proceedings of the 40th Aerospace Mechanisms Symposium*, (2010), 415-430) and usually several antennas are mounted on a single satellite. When operating from a low orbit, e.g. at 700 km altitude, the field of view of a conventional non-directional satellite antenna is a circle of 5000 km diameter. The zone can contain a large multitude of devices and the signals from them will overlap in time and interfere with each other. A directional beam would reduce the field of view and likelihood of mutual interference between signals. It would also amplify the signal at the receiver. However, formation of directional and steerable radio beam in VHF and UHF bands requires a large antenna, many times exceeding the standard nanosatellite dimensions. For this reason, antennas capable of generating directional and steerable radio beams are not yet used in the current nanosatellite missions.

The U.S. patent application Ser. No. 07/902,107 disclosed a spacecraft antenna, which is a self-deploying monopoly vibrator system. The major disadvantage of this antenna design is the need for additional guiding structures and a broad transverse plane, on which the monopoly vibrators are mounted. For this reason, the antenna cannot be placed and deployed on a nanosatellite due to its structure and weight. European patent application EP20130003752 disclosed a deployable nanosatellite antenna of helical structure for UHF and VHF bands. This design allows placement of a deployable antenna in a standard-sized nanosatellite, which in the extended configuration is larger than the satellite itself or a standard type monopole nanosatellite antenna. Thus the signal is amplified, yet the direction of the radio beam cannot be changed without turning the antenna itself.

US patent publication No U.S. Pat. No. 5,313,221 discloses a phased array monopole antenna having a single layer membrane upon which plurality of antenna units are attached. Each antenna unit has a flexible curved antenna blade which bends over or springs up when the membrane is rolled or unrolled on a drum. Main disadvantage of this prior art is use of complicated unrolling means for unrolling array monopole antenna which imparts additional weight to a spacecraft and may lead to faulty unfolding.

Publication by Kelleher S. et al. "Electronic scanning for satellites" in proceedings of the National Electronics Conference, vol. 17, 1 Jan. 1961, pages 290-300, XP001387797, discloses a dipole antenna made of one or more panels of printed circuit hybrids and interconnected with coaxial lines. The antenna is deployed by deployment means such as inflation means, flares. Such antenna requires a difficult folding pattern and additional means for unfolding such antenna which may lead to faulty or difficult deployment.

Publication by J. Costantine et al: "*Deployable antennas for CubeSat and space communications*", 2012 6th European Conference On Antennas And Propagation (EUCAP), 1 Mar. 2012, pages 837-840, XP055250476 discloses two UHF antenna concepts. A first antenna is a conical log spiral antenna while a second antenna is a log periodic crossed dipole antenna array. Design of these two antennas is such that they require means for deployment like a one way linear or rotary actuator. It leads to increased weight and need for additional space in the compartment of a satellite. As well as such antenna may lead to faulty or difficult deployment.

This invention seeks to circumvent the said limitations of nanosatellite antennas by proposing a phased array antenna of deployable construction made of many monopole electric vibrators that could be placed in a standard-sized nanosatellite and deployed from it. The invention makes it possible to place phased array antennas into a small satellite and to take advantage of this type of antennas, such as ability to steer the beam, simultaneous generation of several beams, amplification of desirable signals and suppression of undesirable signals.

BRIEF DESCRIPTION OF THE INVENTION

The proposed deployable phased array antenna can be made from a strip of lightweight shape memory electrically conductive alloy or another lightweight resilient electrically conductive material that is capable to fully extend after deformation and that includes strip branches forming distinct monopole or dipole electric vibrators. In the folded state, the antenna looks like a strip roll and can be placed on a satellite. When in orbit, the antenna automatically unfolds after the roll retention mechanism is released and orderly unfolds unrolling from a support frame or otherwise extends. The proposed design of the monopole branches utilizes conductors of minimum length and achieves maximum directivity. A system may include at least two such unfolding antennas thus achieving even greater operational effectiveness regarding beam steerability and interference suppression. To prevent chaotic unfolding of the antenna, additional measures are used to prevent unwinding of inner layers of the roll before the outer layer is extended.

BRIEF DESCRIPTION OF THE DRAWINGS

The following are the drawings for explanation of the invention.

DETAILED DESCRIPTION OF THE INVENTION

Figure 1:
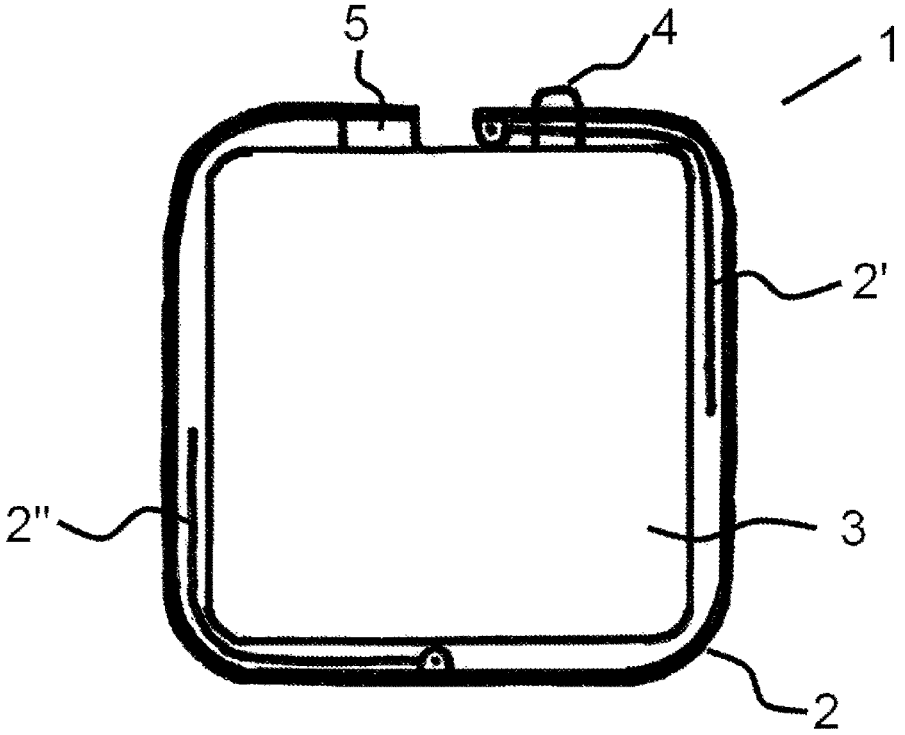
FIG. 1: An example of how an antenna is rolled up on an antenna support in the satellite camera.
Figure 2:
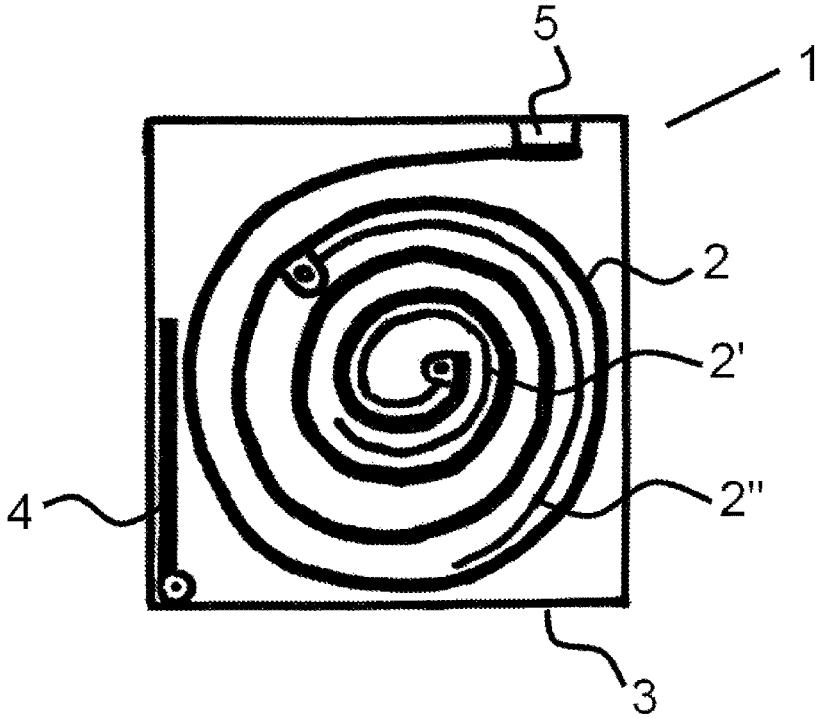
FIG. 2: An example of attachment of antenna roll-up support to the satellite.

FIG. 1 and FIG. 2 presents methods of attachment of strip elements (2, 2', 2") of a phased array antenna (1) as designed for nanosatellites to the antenna (1) mounting chamber (3) for mounting the antenna (1) to a nanosatellite, but not limited to winding of the antenna (1) strip elements (2, 2', 2") around the mounting chamber (3), rolling of the antenna strip members (2, 2', 2") into a roll for placement inside the mounting chamber (3), and folding of the antenna strip elements (2, 2', 2") for placement inside the mounting chamber (3). In all cases, one end of the antenna transverse strip member (2) is fixed to the mount in the nanosatellite mounting chamber (3) by a fixing accessory (5) and the other end is free. The antenna (1) strip members (2, 2', 2") are securely held in a collapsed state occupying the least space volume and the monopole electrical vibrators (2', 2") and the transverse strip member (2) make an angle close to 0° at the line of attachment until the satellite reaches the intended orbit. Upon reaching the deployment location, 30 the holding element (4) is released and the antenna stripe members (2, 2', 2") unroll until the antenna gains the intended shape. In the unfolded state, the antenna (1) transverse member (2) and the monopole electric vibrators (2', 2") make an angle larger than 0° at the line of attachment.

In all cases, the antenna (1) comprises unfolding members (2, 2', 2") and the mounting chamber (3) for mounting to the nanosatellite, where the phased array antenna (1) strip elements (2, 2', 2") can be fastened to it, rolled upon it and subsequently released or can be placed inside the said mounting chamber (3) for mounting to the satellite. The transverse strip members (2, 2', 2") comprises a transverse strip member (2) and at least one additional strip member (2', 2") hingedly connected to the transverse strip member (2) which forms a distinct monopole electric vibrator of the antenna (1).

Figure 3:
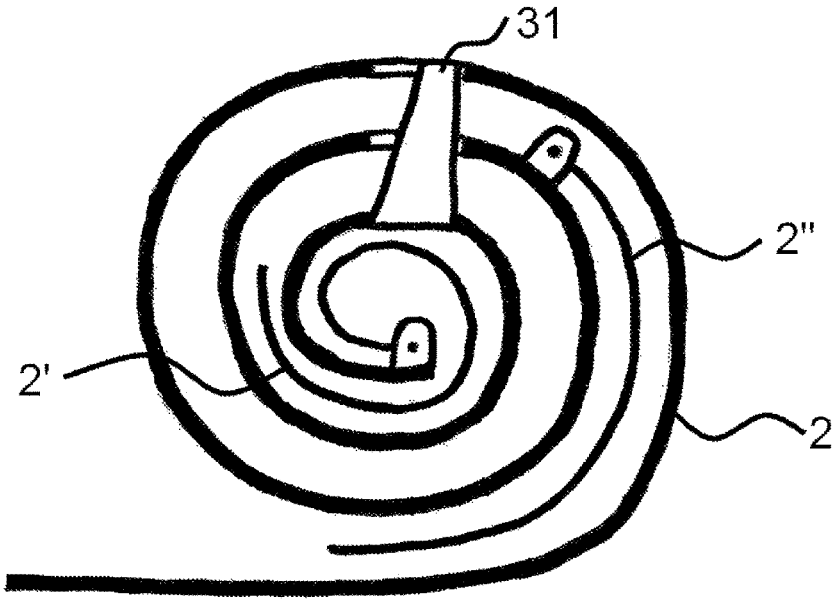
FIG. 3: A guiding element for deflection of unfolding antenna strip members.

FIG. 3 presents an example of a guiding element (31) for unrolling of the phased array antenna (1) strip members (2, 2', 2"). This element (31) is intended to ensure orderly unrolling of the antenna (1) strip elements (2, 2', 2") by preventing the inner layers to unroll before the outer layers. This element (31) is attached close to the free end of the transverse strip element (2), which is located in the inner part of the strip elements roller. A sticky or pasty material between the roll layers can also be used for this purpose.

Figure 4:
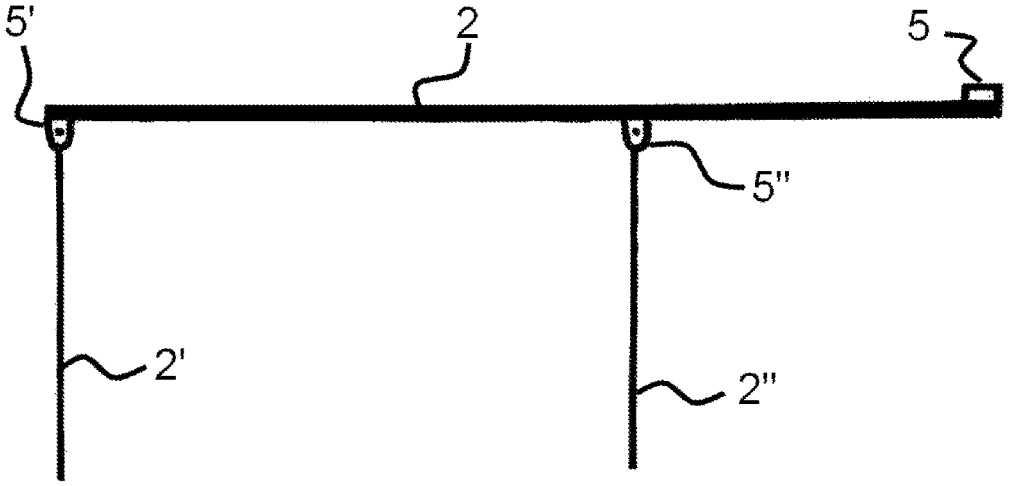
FIG. 4: a single phased array antenna in unfolded state.

FIG. 4 shows an unfolded strip part of the phased array antenna (1) consisting of a fixing accessory (5) for attachment of the antenna (1) to the antenna (1) mounting chamber (3), the transverse strip member (2), and at least two branching monopole electric vibrators (2', 2"). The antenna may also comprise two transverse members (2) attached to the satellite, each of which has an attached monopole electric vibrator (2', 2"). In this case, both transverse members will unfold from the mounting chamber (3) in opposite directions in the same way as in case of one transverse member, only in opposite directions.

At least two said branching monopole electric vibrators (2', 2") are fastened to the transverse strip member (2) via lightweight spring elements or lightweight articulated elements (5', 5") for easy unbending to essentially upright position relative to the transverse strip member (2). Although the drawing shows only two branching strip elements (2', 2"), their number can be much larger and they can be mounted on both sides of the transverse strip member (2).

The phased array antenna (1) with two branching monopole electric vibrators (2', 2") can receive/transmit a circularly polarized signal or simultaneously receive/transmit two signals of different linear polarization.

All strip members (2, 2', 2") of the phased array antenna (1) can be made of an electrically conductive shape-memory alloy or other electrically conductive resilient material such as a steel band. The transverse strip member can be provided with additional signal conduits (91, 93), such as cables or current conducting paths. The antenna (1) of this type includes conductors of minimum size since the transverse belt element (2) performs the function of the dipole arm.

FIGS. 5-8 show some examples how monopoly electric vibrators (52', 62', 62"; 72', 72", 82', 82") can be attached to the transverse strip member (2) of the phased array antenna (1).

Figure 5:
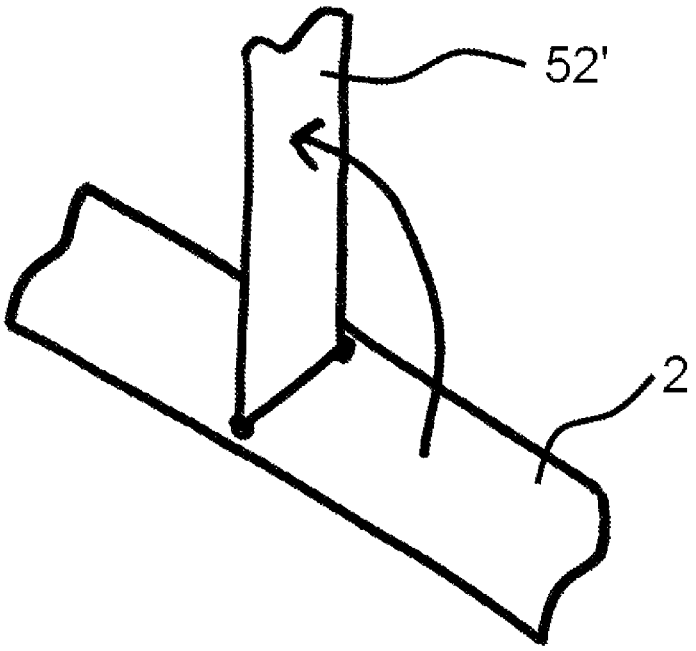
FIG. 5-8 presents examples of attachment methods of monopole electric vibrators of a phased array antenna to the transversal antenna member.

FIG. 5 shows the simplest assembly of the transverse strip member (2) of the phased array antenna (1) and a monopole electric vibrator (52'), where polarization of the phased array consisting of a transverse strip element and a monopoly vibrator (52') is linear. The electrical vibrator (52'), the folding axis of which is parallel to the transverse strip element (52) plane, unbends after the transverse element (2) is unrolled. The planes of both members (2, 52') in extended state are orthogonal to each other.

Figure 6:
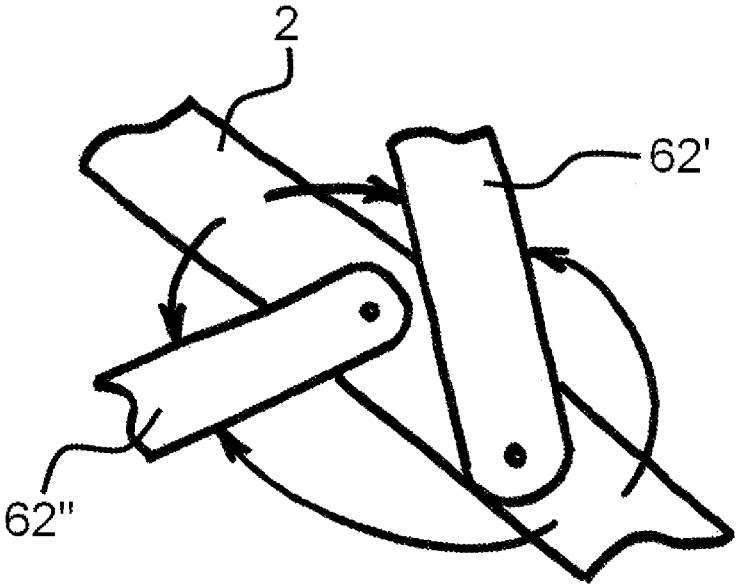
Figure 7:
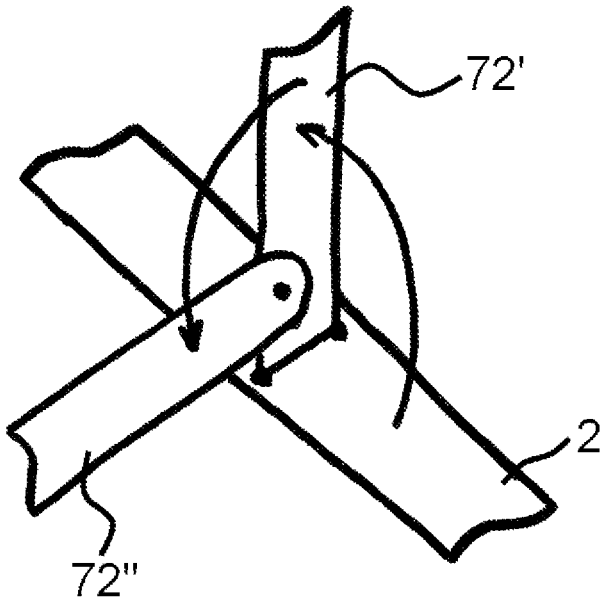
Figure 8:
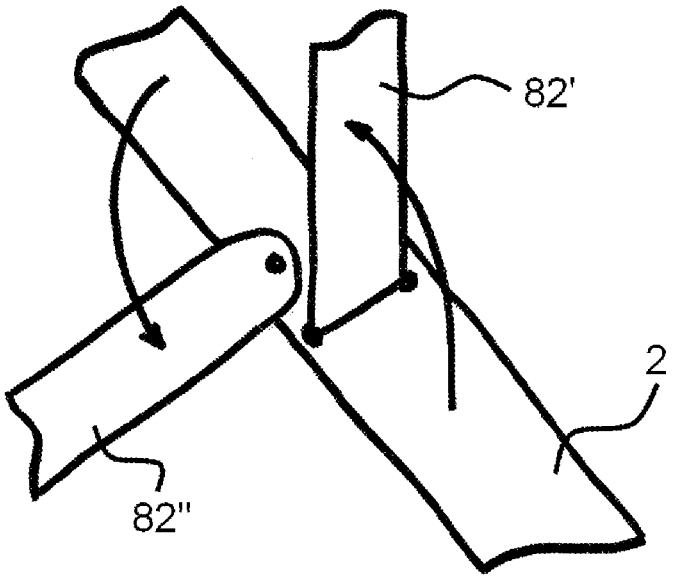

FIGS. 6-8 show cases, when monopole electric vibrators (62', 62", 72', 72", 82', 82") are fixed to the transverse member (2) of the phased array antenna (1) in pairs next to each other. Each said vibrator (62', 62", 72', 72", 82', 82") in a pair has a linear polarization perpendicular to that of each other and a pair of vibrators has a circular polarization.

FIG. 6 shows monopole electric vibrators (62', 62"), folding axes of which are perpendicular to the plane of the transverse stripe member (2) and which unbend to 45 degrees when the transversal strip (2) is unrolled. If vibrators are not stacked upon each other in the folded state, then one vibrator (62') tilts to 45 degrees, and the other (62") tilts to 125 degrees. In the folded state, the planes of all three said strip elements (2, 62', 62") are parallel. In the unfolded state, the planes of the vibrators (62', 62") are parallel and perpendicular to the plane of the transverse strip member (2).

The electric vibrator (72') in FIG. 7, the folding axis of which is perpendicular to the plane of the transverse stripe member (2), unbends to 90 degrees when the transversal strip (2) is unrolled. The electric vibrator (72"), the folding axis of which is perpendicular to the plane of the vibrator (72'), unbends to 90 degrees when the vibrator (72') is extended. The strip elements (2, 72', 72") are stacked upon each other in the folded state.

FIG. 8 shows electric vibrators (82', 82") that unbend to 90 degrees when the transversal member (2) is unrolled. The folding axis of one electric vibrator (82") is perpendicular to the transversal member (2) plane, and the axis of the other vibrator (82') is parallel to the transversal member (2) plane. In the extended state, the plane of two strip members (2', 82") are parallel and perpendicular to the plane of the third strip member (82').

Figure 9:
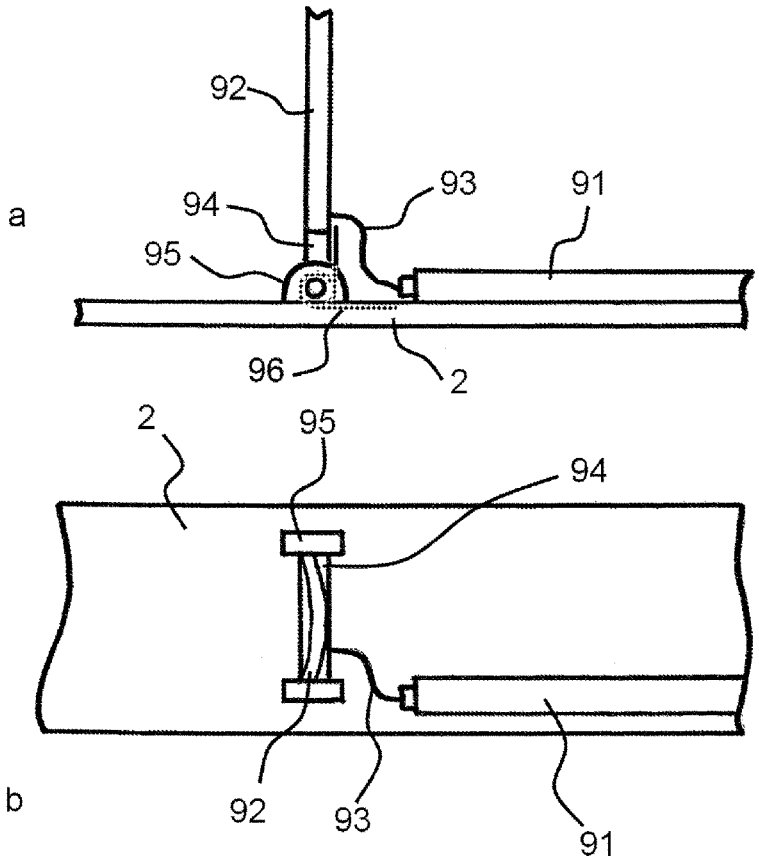
FIGS. 9*a* and 9*b* presents an example of attachment method of monopole electric vibrators to the transversal antenna member via an insulator and a hinging element and wiring to the signal transmission line respectively from side and from above.

FIGS. 9*a* and 9*b* present an example, where at least one monopoly electric vibrator (92') of the phased array antenna (1) is attached to the transversal strip member (2) via an electrically insulating element (94) and means (96) facilitating extension of the said monopole vibrator (92'), such as a spring element. Additionally, at least one monopole vibrator of the antenna can be connected to the spacecraft signal receiver/transmitter via signal conduits (91, 93), such as cables, or electrical current conducting paths.

Figure 10:
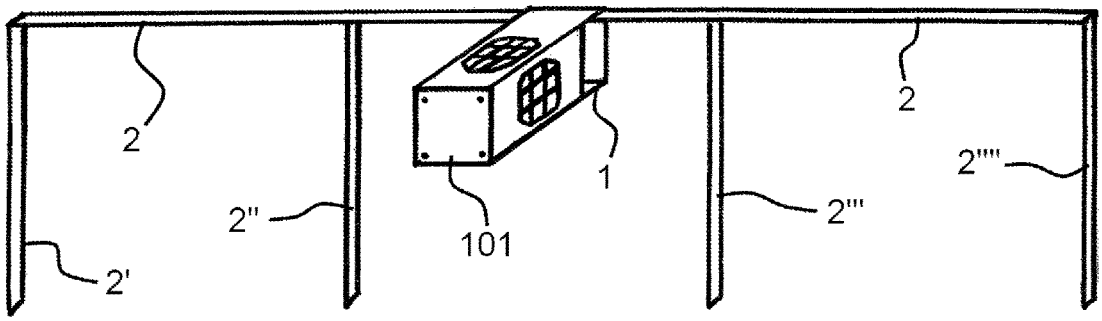
FIG. 10: An example of a phased array antenna system.

FIG. 10 shows an example, where a system is constructed from phased array antennas (1) and consists of at least two transversal strip elements (2), which extend from the mounting chamber (3) for mounting to the spacecraft (101) and to which the monopole electric vibrators (2', 2'', 2''', 2'''') are attached. A satellite (101) may have more than two phased array antennas (1), depending on the structure of the satellite itself.

Compared with conventional deployable nanosatellite monopole antennas, a phased array antenna according to the invention has a narrower field of view, higher gain factor, and ability to steer the beam by changing the signal phases of individual antenna elements.

The invention claimed is:

1. A self-deploying antenna for spacecraft, comprising:

at least one pair of transversal members, each of the transversal members of the at least one pair of transversal members being made of a first self-straightening metal strip;

a mounting chamber for mounting the antenna to the spacecraft, wherein each of the transversal members of the at least one pair of transversal members have a first end and an opposite second end, the first end attached to the mounting chamber and the second end being free; and a plurality of monopole electric vibrators made of a second self-straightening metal strip and attached to the transversal members of the at least one pair of transversal members, wherein a first joint angle between one transversal member of the at least one pair of transversal members and at least one of said monopole electric vibrators is close to zero when the antenna is in un-deployed transportation state, and a second joint angle between another transversal member of the at least one pair of transversal members and at least one monopole electric vibrator associated with said another transversal member is close to zero when the antenna is in the un-deployed transportation state, the first joint angle between the one transversal member and the at least one monopole electric vibrator associated with said one transversal member is greater than zero when the antenna is in a deployed state, and the second joint angle between the another transversal member and the at least one monopole electric vibrator associated with said another transversal member is greater than zero when the antenna is in deployed state, and wherein monopole electric vibrators associated with said one transversal member and monopole electric vibrators associated with said another transversal member are configured to unbend in different direction respectively.

2. The self-deploying antenna in accordance with claim 1, wherein the monopole electric vibrators, which are attached to the transverse member, unbend in different directions.

3. The self-deploying antenna in accordance with claim 1, wherein a member, which is attached to one of the monopole electric vibrators of the transverse member, unbends at an angle to the said monopole vibrator.

4. The self-deploying antenna in accordance with claim 1, wherein the monopole electric vibrators, which are attached to the transverse member, unbend into different planes.

5. The self-deploying antenna in accordance with claim 1, wherein the antenna further comprises a guiding element for guided unrolling of the antenna.

6. The self-deploying antenna in accordance with claim 1, wherein plural of monopole electric vibrators, which are attached to any one transverse member of the pair of transverse members unbend in different directions.

7. The self-deploying antenna in accordance with claim 1, wherein at least one monopole electric vibrator, which is attached to another monopole electric vibrator of the any one of the pair of transverse members, is at an angle when unbent to said at least one monopole electric vibrator.

8. The self-deploying antenna in accordance with claim 1, wherein plural of the monopole electric vibrators, which are attached to at least any one transverse member of the pair of transverse members, unbend into different planes.

* * * * *